United States Patent [19]

Ozawa

[11] 4,443,124

[45] Apr. 17, 1984

[54] PRINTER WITH ELECTROMAGNETICALLY DRIVEN HAMMER

[75] Inventor: Toshiaki Ozawa, Tokyo, Japan

[73] Assignee: Canon Kabushiki Kaisha, Tokyo, Japan

[21] Appl. No.: 513,784

[22] Filed: Jul. 15, 1983

Related U.S. Application Data

[63] Continuation of Ser. No. 330,721, Dec. 14, 1981, abandoned, which is a continuation of Ser. No. 104,844, Dec. 28, 1979, abandoned.

[30] Foreign Application Priority Data

Dec. 23, 1978 [JP] Japan ..... 53-161467

[51] Int. Cl.[3] ..... B41J 9/38; B41J 33/26; B41J 33/32

[52] U.S. Cl. ..... 400/185; 400/144.2; 400/157.2; 400/225; 400/229

[58] Field of Search ..... 400/144.2, 144.3, 157.1, 400/157.2, 185, 223, 225, 229

[56] References Cited

U.S. PATENT DOCUMENTS

| | | | |
|---|---|---|---|
| 2,044,072 | 6/1936 | Going | 400/235.1 X |
| 3,063,539 | 11/1962 | Howard | 400/235.1 X |
| 3,386,378 | 6/1968 | Bradbury et al. | 400/157.2 X |
| 3,404,628 | 7/1969 | Lee . | |
| 3,603,442 | 9/1971 | Ward et al. | 400/124 |
| 3,810,195 | 5/1974 | Kilroy et al. | 101/93.04 X |
| 4,030,591 | 6/1977 | Martin et al. | 400/144.2 X |
| 4,036,349 | 7/1977 | Feldman et al. . | |

*Primary Examiner*—Paul T. Sewell

*Attorney, Agent, or Firm*—Fitzpatrick, Cella, Harper & Scinto

[57] ABSTRACT

A printer provided with an electrically operable printing hammer and an ink ribbon feeding mechanism. The number of components necessary for such type of printer is substantially reduced by using a single and common driving source to operate both of the printing hammer and ribbon feeding mechanism.

8 Claims, 7 Drawing Figures

PRINTER WITH ELECTROMAGNETICALLY DRIVEN HAMMER

This application is a continuation of application Ser. No. 330,721 filed Dec. 14, 1981, now abandoned, which in turn is a continuation of application Ser. No. 104,844, filed Dec. 28, 1979, now abandoned.

BACKGROUND OF THE INVENTION

1. Field of the Invention

The present invention relates to a printer provided with a printing hammer, an ink ribbon and an ink ribbon feeding mechanism.

2. Description of the Prior Art

With a rapid development of electronics in recent years there is an increasing tendency to replace mechanical components and elements in printers by electronic ones aiming at further improvement in reliability of printers. However, since various and separate driving sources and electrical control elements are required, in this case, to move the carriage, to rotate the type wheel and to operate the ink ribbon feeding mechanism and printing hammer, the cost of such printer employing electronic components and elements becomes relatively high as compared to the conventional printer using mechanical ones.

SUMMARY OF THE INVENTION

Accordingly, it is an object of the present invention to provide an inexpensive printer of the above mentioned type by reducing the number of electric elements required for its control system.

It is another object of the invention to provide a printer in which the driving sources are used most effectively.

To attain the above objects according to the invention it is proposed to operate the ink ribbon feeding mechanism and printing hammer using one and the same driving source.

The present invention is based on findings that for known electronic printers there is a relatively long rest time period of the printing hammer driving source and that making use of the long rest time period, the ink ribbon feeding mechanism may be driven by the same driving source for the printing hammer.

In connection with the above, it is a further object of the invention to provide the above described type of printer in which the printing hammer is movable by means of spring energy as well as electric energy for its reciprocal movement, and printing and feeding of the ink ribbon can be effected by one reciprocal motion of the printing hammer.

It is still a further object of the invention to provide a printer in which, in one printing cycle, feeding of the ink ribbon is carried out during the forward movement of printing hammer and printing is carried out during the backward movement thereof.

It is also an object of the invention to provide a printer in which the spring energy constituting a portion of printing energy is accumulated during the course of a forward movement of the printing hammer.

Other and further objects, features and advantages of the invention will be understood more fully from the following description in connection with the accompanying drawings.

DESCRIPTION OF THE PREFERRED EMBODIMENTS

Figure 1:
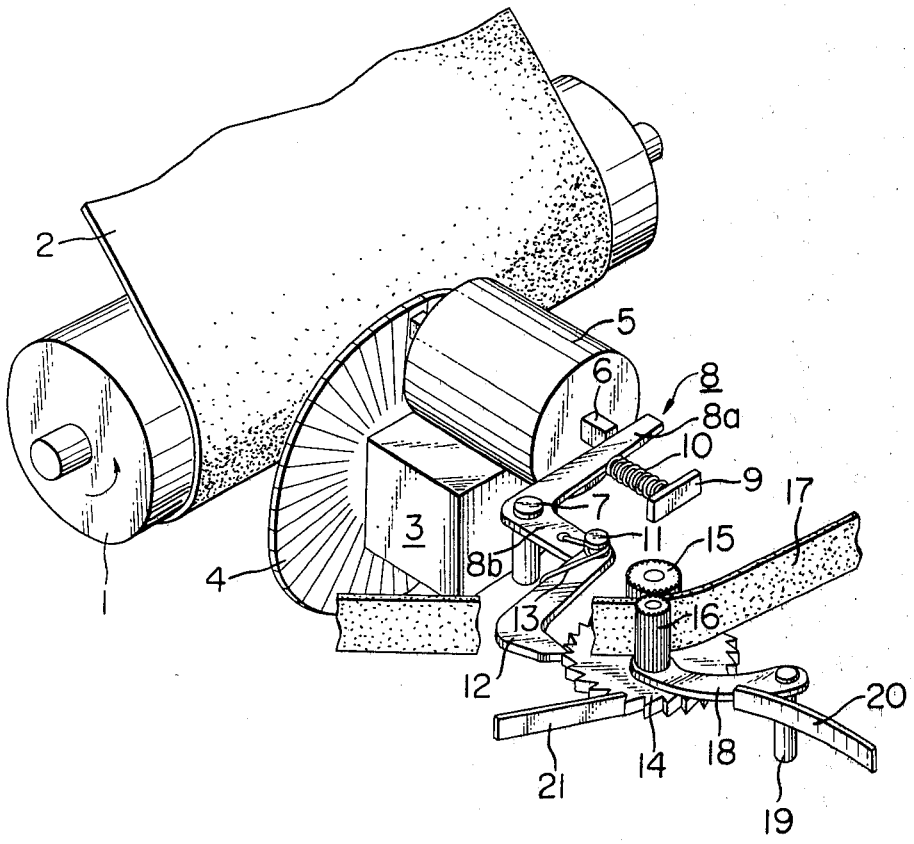
FIG. 1 is a perspective view of a printer in accordance with an embodiment of the present invention.

In FIG. 1, reference numeral 1 designates a platen known per se serving to feed recording paper 2. While not shown in the drawing, the printer comprises a carriage on which a motor 3 is mounted in a well-known manner. In a position corresponding to the printing position on the platen 1 there is provided a type wheel 4 fixed to the driving shaft of the motor 3. The type wheel 4 constitutes a recording member for writing information on the recording paper. Behind the type wheel there is provided a printing hammer 6 which is moved forward and backward by an electromagnetic mechanism 5 in a manner described later in detail. The printing hammer 6 is means for actuating the recording member.

On the non-printing side of the printing hammer 6 there is provided an L-shaped lever 8 pivotable about a pin 7 in an approximately horizontal plane. The pivot pin 7 is mounted on the above-mentioned carriage not shown. Disposed between the one arm **8*a* of the lever and a stationary plate 9 is a compression spring 10 which has a bias force urging the lever arm 8*a* against the non-printing side end surface of the printing hammer 6. At the end of another arm 8*b* of the L-shaped lever there is provided a pin 11 which supports a ratchet pawl 12 rotatably about the pin. Disposed on the pin 11 is a torsion coil spring 13 one end of which is fastened to the lever 8 and the other end to the ratchet pawl 12. Under the spring force of the torsion coil spring 13 the ratchet pawl 12 is brought into engagement with a ratchet 14. The ratchet 14 has, on its upper surface, a gear 15 integrally formed with the ratchet. The gear 15 is in contact with a gear 16 on an arm 18. An ink ribbon 17 is interposed between the two gears 15 and 16. The second gear 16 is rotatably supported on one end of the arm 18 another end of which is connected to a pivot pin 19. Designated by 20 is a leaf spring for pressing the arm 18 and 21 is a check leaf spring for preventing counter rotation of the ratchet 14**.

Figure 2:
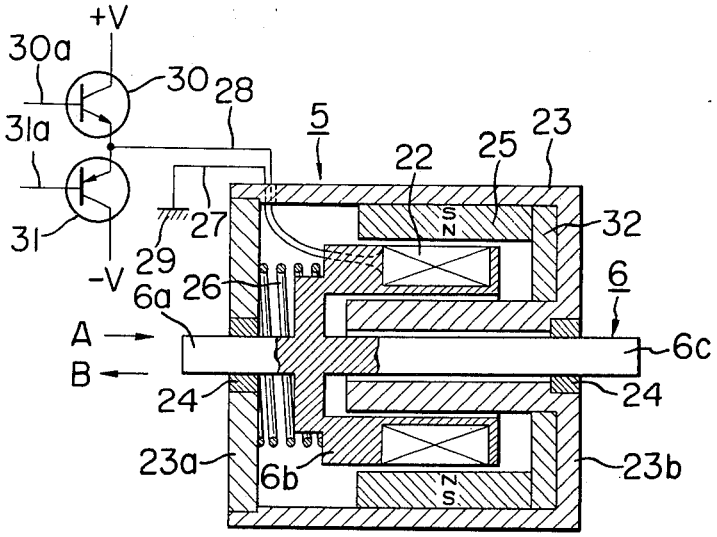
FIG. 2 is a vertical cross-sectional view of the electromagnetic mechanism used in the printer shown in FIG. 1.

FIG. 2 shows in detail the electromagnetic mechanism. The printing hammer 6 comprises printing portion **6*a*, cylindrical bobbin portion 6*b* for supporting a coil 22 and ink ribbon feed driving portion 6*c*. As a whole, the printing hammer is slidably supported by bearings 24 and 24 provided in the cover 23*a* and bottom 23*b* of a casing 23, respectively. On the inner circumferential surface of the casing there is a cylindrical magnet 25 surrounding the coil 22. In the shown embodiment, the magnet 25 is so magnetized as to have its N-pole on the inner side and its S-pole on the outer side. For another case there may be used a magnet magnetized in the opposite polarity. Between the inner surface of the cover 23***a* and the bobbin portion 6*b* there is disposed a compression spring 26. Flexible lead wires 27 and 28 extend from the coil 22. One lead wire 27 is connected to ground 29 and the other 28 is connected to the emitter connection of transistors 30 and 31. Interposed between the magnet 25 and the bottom surface of the casing is a non-magnetic substance 32.

In the shown embodiment, source +V is applied to both ends of the coil 22 when a driving signal is input to the base 30*a* of transistor 30 to turn it on. At this phase of operation, the printing hammer 6 is moved in the ribbon feeding direction (forward motion), that is, in the direction of arrow A under the action of magnet 25 and coil 22. When the other transistor 31 receives a driving signal at its base electrode 31*a* and becomes conductive, source −V is applied to the both ends of the coil 22 so as to move the printing hammer 6 in the opposite direction (backward motion), that is, in the direction of arrow B.

Figure 3:
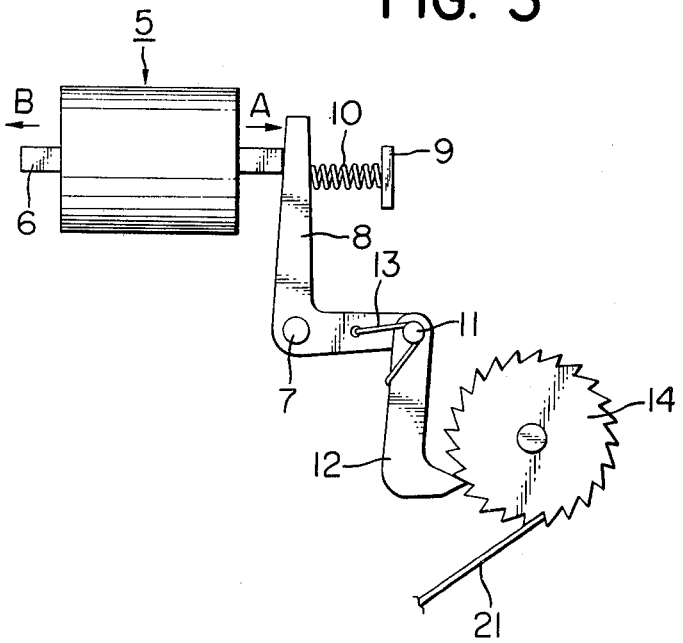
FIG. 3 illustrates schematically a ratchet device mechanism operable with the electromagnetic mechanism.

The manner of operation of the above-described printer will be discussed below:

In FIGS. 2 and 3, the apparatus is shown in its rest position in which both transistors 30 and 31 are off and the printing hammer 6 remains still under the balance held between the two compression coil springs.

In this position, if a driving signal is applied to base 30*a* of transistor 30, then the sum of electromagnetic energy and spring force of the compression coil spring 26 will overcome the spring force of the coil spring 10. Thus, the printing hammer 6 is moved in the direction of arrow A while compressing the spring 10 and the L-shaped lever 8 is rotated clockwise. By this rotation of the lever 8, the ratchet pawl 12 is driven under the action of torsion coil spring 13 to rotate the ratchet 14 by one tooth step. With the rotation of the ratchet 14 the gear 15 also rotates to feed the ink ribbon 17 by a predetermined segment length.

At the next phase, when the transistor 30 is turned off and a driving signal is applied to base 31*a* of transistor 31, the printing hammer 6 is moved in the direction of arrow B by the total action of electromagnetic energy and spring force of the compression coil spring 10 while compressing the spring 26. The printing hammer strikes the type wheel 4 to effect printing on the recording paper 2.

The extension of compression coil spring 10 returns the lever 8 to the position shown in FIG. 3, which will in turn bring the pawl 12 into engagement with the next tooth of ratchet 14.

When the transistor 31 is turned off after printing, the extension of compression coil spring 26 moves the printing hammer 6 in the direction of arrow A up to its starting (staying) position shown in FIGS. 2 and 3.

Figure 4:
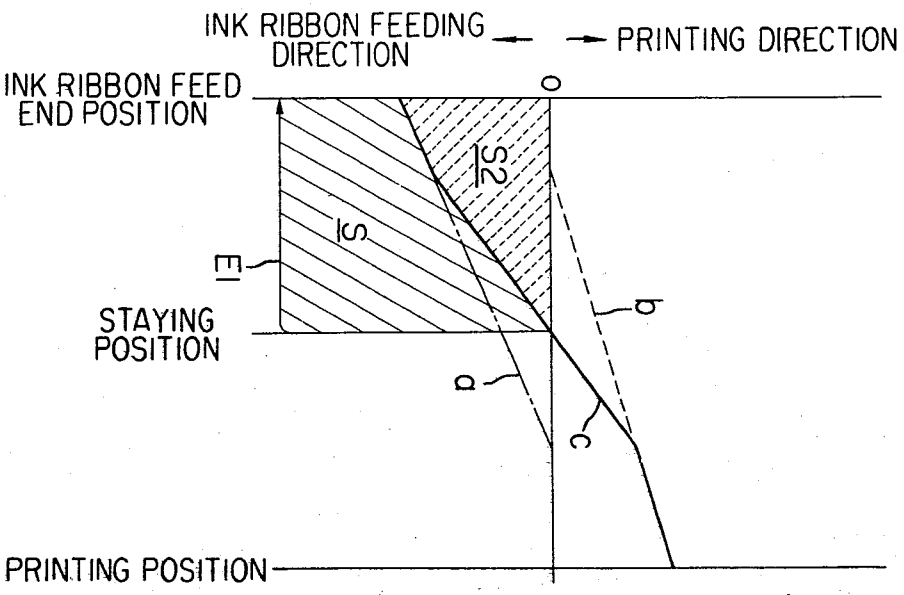
FIG. 4 shows a relation curve of spring force and electromagnetic energy obtained during the time of ink ribbon feeding.
Figure 5:
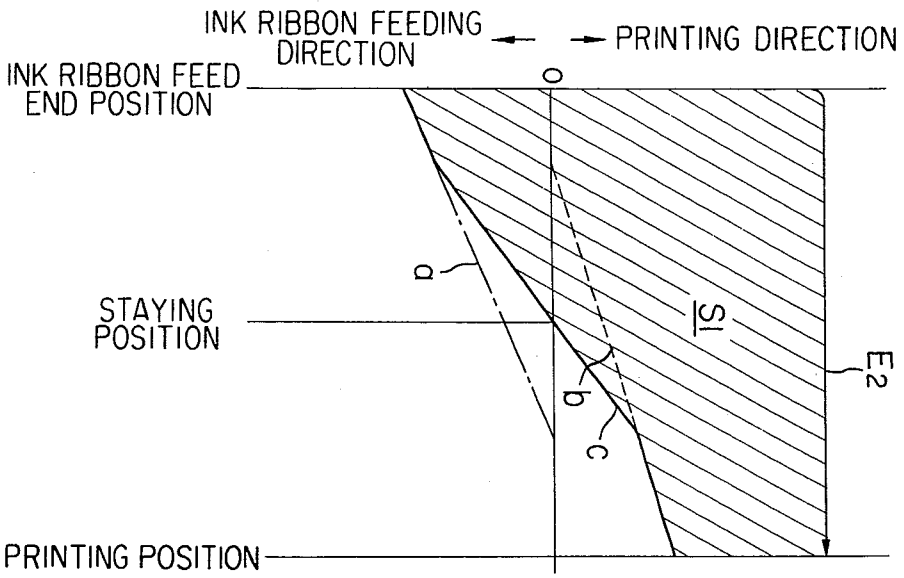
FIG. 5 shows a similar relation curve obtained during printing.

FIGS. 4 and 5 show the relation between the electromagnetic energy and the spring force (spring energy) exerting on the printing hammer 6 by two compression coil springs 10 and 26.

The dot-and-dash line curve a shows the biasing force of spring 10, the dotted line curve b does that of spring 26 and the solid line curve c is the resultant force of two springs 10 and 26. In the staying position, the spring force acting on the printing hammer is 0 (zero). During the movement of spring hammer 6 in the ink ribbon feeding direction indicated by arrow A or in the printing direction indicated by arrow B, the compression coil spring 10 or 26 intends to move the hammer 6 back to its staying position.

When a voltage +V is applied to the coil 22 to move the printing hammer from its staying position to ink ribbon fed end position there is produced a certain amount of electromagnetic energy as shown by solid curve E1 in FIG. 4. The amount of energy actually given to the hammer to feed the ink ribbon is expressed by the hatched area S which is obtained by deducting the resultant spring force c from the electromagnetic energy E1.

After feeding the ink ribbon there is applied a voltage −V to move the printing hammer 6 from the ink ribbon feed end position toward the printing position. The electromagnetic energy produced at the time is shown by solid curve E2 in FIG. 5. The actual amount of energy available for moving the printing hammer at this time is expressed by the hatched area S2. In the range of from the ink ribbon feed end position to staying position, the actual energy S1 corresponds to the sum of electromagnetic energy E2 and spring force c and in the range of from the staying position to the printing position it corresponds to the balance between E2 and c.

As will be understood from the above, during the movement of the printing hammer 6 in the ink ribbon feeding direction, an amount of spring energy corresponding to the dotted area S2 is accumulated. Therefore, the moving speed of printing hammer 6 can be increased by this accumulated energy and at the same time the current to the coil 22 can be reduced by this accumulated energy.

Figure 6:
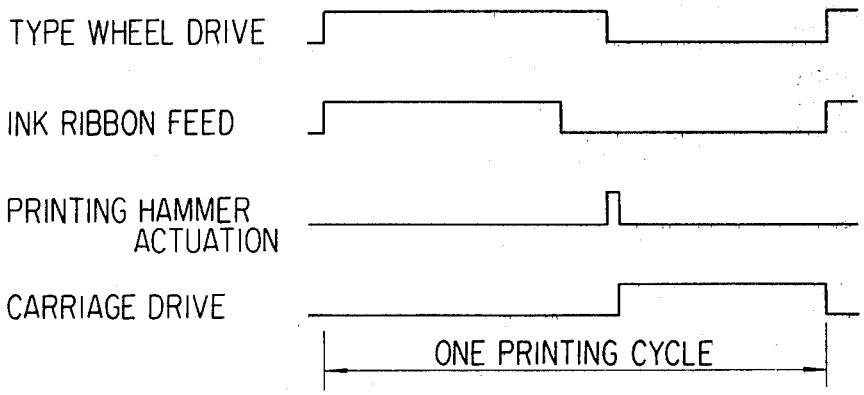
FIG. 6 is a timing chart of a printer according to the prior art.

FIG. 6 is a timing chart of a printer according to the prior art.

At the first step of one printing cycle, the type wheel drive and ink ribbon feed are started at the same time. After selecting a character to be printed, the type wheel is stopped and then the printing hammer is actuated to effect printing. After printing, the carriage is moved a certain predetermined distance to complete the printing cycle.

It is clearly seen that the operation time of printing hammer is very short and its rest time is long.

Figure 7:
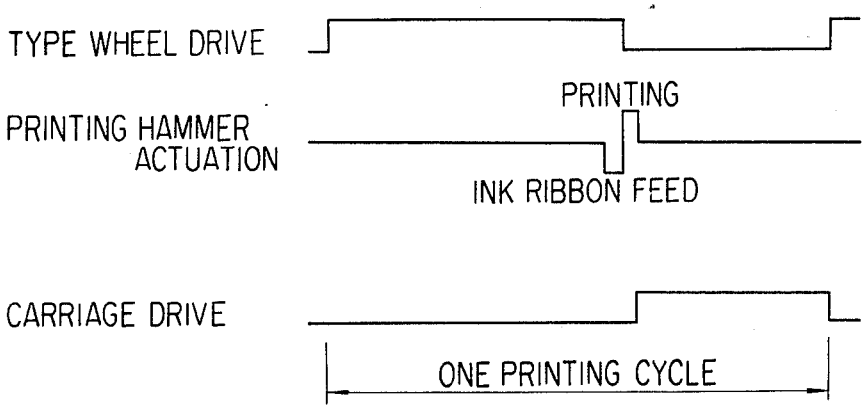
FIG. 7 is a similar timing chart according to the present invention.

FIG. 7 is a similar timing chart of a printer according to the present invention.

After the type wheel drive and before the completion of character selection, the printing hammer is once actuated to feed the ink ribbon. At the time of the type wheel being stopped, the printing hammer is again actuated to effect printing. After printing, the carriage is moved a certain distance to complete the printing cycle. In the case of continuous printing operation it is preferable to carry out the type wheel drive and ink ribbon feed during the movement of the carriage.

The advantage of the present invention is obvious from the above two timing charts. According to the invention, printing and feeding of the ink ribbon are carried out by one forward and backward motion of one driving source. Therefore, the number of the necessary driving sources and electrical elements in the control system can be reduced to minimum, which enables to provide an inexpensive printer. It is another advantage of the invention that the single and same driving source can be used fully and most effectively.

Since the ink ribbon feed is carried out immediately before printing action according to the invention, it is not always necessary to position the printing hammer at a constant position after printing. At the start time of the printing action, the printing hammer is always in a definite position, that is, the ink ribbon feed end position. To effect printing the printing hammer always starts from the ink ribbon feed end position. This brings forth a further advantage of higher and stabler quality of printing.

It may be considered that the electromagnetic mechanism 5 be used solely for printing action and the ink ribbon feed be carried out by using only the extension of the compression coil spring 26 provided that a stronger spring should be used as the compression spring 26. However, this is not useful in particular when it is desired to operate the printing hammer at high speed but with small electric power because of a high load applied on the electromagnetic mechanism at the time of printing action.

While the invention has been particularly shown and described with reference to a preferred embodiment thereof, it will be understood that various modifications may easily be made without departing from the scope and spirit of the invention. The printer with a type wheel shown in the above embodiment is only an example of various printers to which the present invention is applicable. The concept of the invention is applicable also, for example, to such type of printer in which a thermal head is used as a printing member and the thermal head is pressed against a recording medium through an ink ribbon to transfer the ink onto the recording medium.

I claim:

1. A printer, comprising:

a lever arrangement for feeding an ink ribbon;

means connected to said lever arrangement for driving said lever arrangement to feed the ink ribbon, said means including a magnet, a coil associated with said magnet and adapted to receive electric voltage from a voltage source, and a reciprocating member operable by said magnet and said coil when said coil receives voltage, wherein one end of said member operates as a hammer to hit a type to effect a print on a recording medium with the ink ribbon when said member is moved in a print direction, and the other end thereof effects a driving operation of the ink ribbon by said lever arrangement when said member is moved in the opposite direction; and a spring connected to said lever arrangement for retaining said member in a predetermined position when electric voltage is not applied to said coil.

2. A printer according to claim 1, wherein said magnet is a permanent magnet and said member includes said coil, said permanent magnet being disposed about said member and said coil being disposed about said permanent magnet.

3. A printer according to claim 1, wherein said spring biases said member in the print direction.

4. A printer according to claim 1, further comprising a character wheel provided with a plurality of types, said plurality of types being hit by said one end of the member.

5. A printer according to claim 1, wherein said member includes said coil.

6. A printer according to claim 1, wherein said magnet is a permanent magnet which is positioned about said member.

7. A printer according to claim 1, further comprising:

a feeding roller having a ratchet for feeding said ink ribbon, said feeding roller by said ratchet engages said lever arrangement.

8. A printer according to claim 5 wherein said magnet is a permanent magnet which is positioned about said member.

* * * * *